US006526632B1

(12) United States Patent
Blythe et al.

(10) Patent No.: US 6,526,632 B1
(45) Date of Patent: Mar. 4, 2003

(54) RECLOSABLE FASTENER WITH SLIDER

(75) Inventors: James S. Blythe, Rochester, NY (US); Ian J. Barclay, Marion, NY (US); Michael W. McManus, Marion, NY (US); Eric A. St. Phillips, Fairport, NY (US)

(73) Assignee: Pactiv Corporation, Lake Forest, IL (US)

( * ) Notice: Subject to any disclaimer, the term of this patent is extended or adjusted under 35 U.S.C. 154(b) by 6 days.

(21) Appl. No.: 09/713,857

(22) Filed: Nov. 16, 2000

(51) Int. Cl.[7] ..... A44B 19/16

(52) U.S. Cl. ..... 24/400; 24/399; 24/388; 24/587

(58) Field of Search ..... 24/400, 405, 388, 24/417, 429, 438, 419, 30.5 R, 30.55, 587

(56) References Cited

U.S. PATENT DOCUMENTS

| | | | | | |
|---|---|---|---|---|---|
| 3,713,923 | A | * | 1/1973 | Laguerre | 156/66 |
| 5,007,143 | A | | 4/1991 | Herrington | |
| 5,010,627 | A | | 4/1991 | Herrington et al. | |
| 5,020,194 | A | | 6/1991 | Herrington et al. | |
| 5,063,644 | A | | 11/1991 | Herrington et al. | |
| 5,067,208 | A | | 11/1991 | Herrington et al. | |
| 5,070,583 | A | | 12/1991 | Herrington | |
| 5,189,764 | A | | 3/1993 | Herrington et al. | |
| 5,301,394 | A | | 4/1994 | Richardson et al. | |
| 5,301,395 | A | | 4/1994 | Richardson et al. | |
| 5,442,838 | A | | 8/1995 | Richardson et al. | |
| 5,448,808 | A | | 9/1995 | Gross | |
| 5,669,715 | A | | 9/1997 | Dobreski et al. | |
| 5,681,115 | A | | 10/1997 | Diederich et al. | |
| 5,713,669 | A | | 2/1998 | Thomas et al. | |
| 5,775,812 | A | | 7/1998 | St. Phillips et al. | |
| 5,836,056 | A | * | 11/1998 | Porchia et al. | 24/399 |
| 5,867,875 | A | | 2/1999 | Beck et al. | |
| 5,871,281 | A | | 2/1999 | Stolmeier et al. | |
| 5,950,285 | A | * | 9/1999 | Porchia et al. | 24/390 |
| 5,991,980 | A | * | 11/1999 | Meager | 24/399 |
| 6,209,287 | B1 | * | 4/2001 | Thieman | 53/133.4 |
| 6,220,754 | B1 | * | 4/2001 | Stiglic et al. | 24/415 |
| 6,286,999 | B1 | * | 9/2001 | Cappel et al. | 24/400 |
| 6,287,001 | B1 | * | 9/2001 | Buchman | 24/400 |
| 6,293,701 | B1 | * | 9/2001 | Tomic | 24/400 |
| 6,306,071 | B1 | * | 10/2001 | Tomic | 493/114 |

* cited by examiner

*Primary Examiner*—Gary Estremsky
*Assistant Examiner*—Andre L. Jackson
(74) *Attorney, Agent, or Firm*—Jenkens & Gilchrist

(57) ABSTRACT

A fastener for plastic bags opened and closed by a slider includes first and second track members with each having one of a pair of interlocking profiles. The fastener has opposite ends with terminations. A slider is mounted on the fastener and has a separation member with a wide portion and a narrow portion positioned in the fastener. The slider, upon complete closure of the fastener, rides up onto a termination moving the wide portion of the separation member out from between the fastener allowing the profiles to lock along the entire length of the fastener.

4 Claims, 4 Drawing Sheets

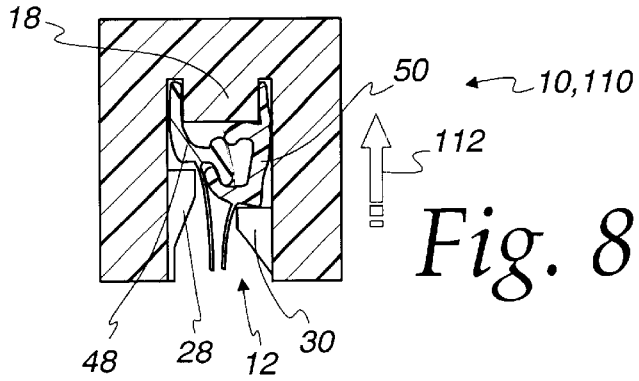
Fig. 8
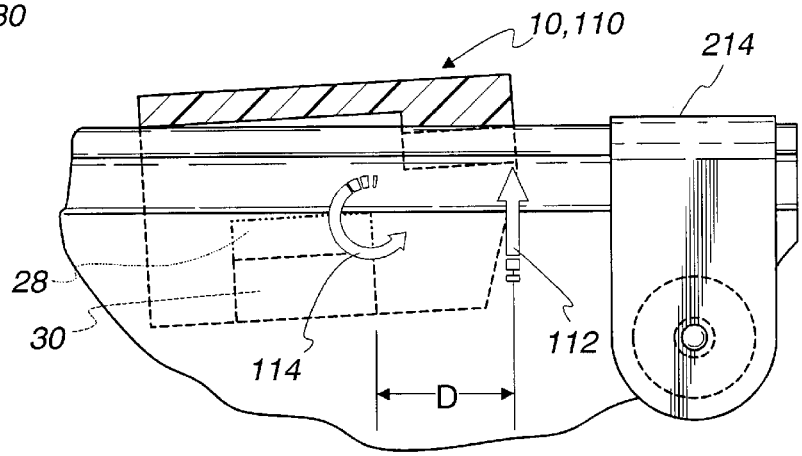
Fig. 9
Fig. 10
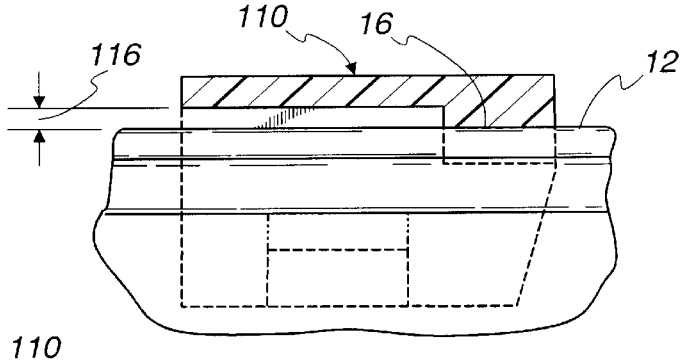
Fig. 11
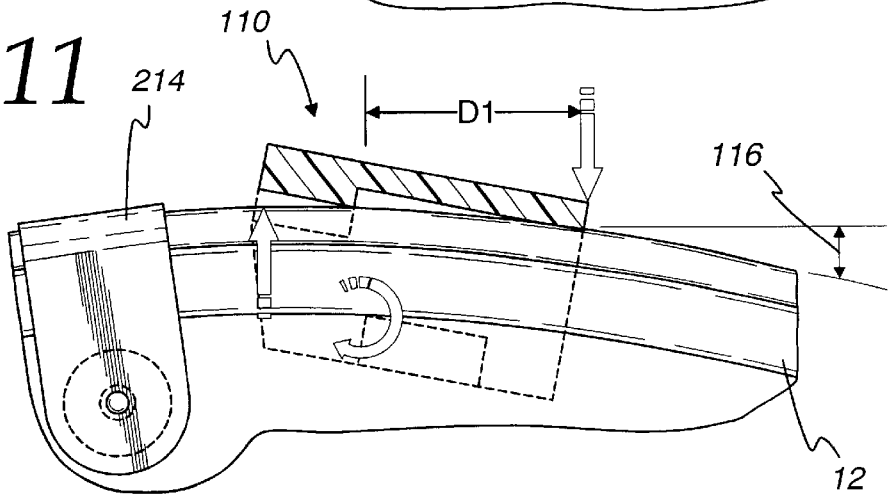

RECLOSABLE FASTENER WITH SLIDER

FIELD OF THE INVENTION

The present invention relates generally to fasteners for plastic bags that are opened and closed by a slider, and, more particularly, to leak resistant fasteners.

BACKGROUND OF THE INVENTION

Plastic bags are a popular household item used for a variety of uses such as storage of food. The addition of reclosable fasteners or zippers to these bags has further enhanced their utility and the addition of a slider has made the fasteners easier to open and close.

Although sliders have made opening and closing the fasteners easier, some of the slider operated fasteners have leakage across the fastener when the fastener is closed. This is caused by a separation member or finger on the slider that extends between sides of the fastener. Even when the fastener is completely closed, a portion of the separation member extends into the fastener preventing closure of the fastener at that location. One solution to this leakage has been to remove a portion of a fastener track at the location of the slider in the fastener closed position. When the slider is in this location, the separation member is in this portion of the fastener track and the fastener is completely closed. Precise sizing and locating the removed portion is difficult and failure to remove the correct amount and in the correct location can result in leaking and possible operation failure of the slider.

Another solution to the problem of leakage is a slider with a pivoting separation member. When the slider is moved to close the fastener, the separation member pivots out of the fastener. When the slider is reversed to open the fastener, the separation member pivots down into the fastener. An example of this slider is disclosed in U.S. Pat. No. 5,871,281. These sliders are complex to design and manufacture and are costly. In addition, the fact that the separation member must pivot to operate impacts the reliability of the slider. There is a need for a low cost, highly reliable slider and reclosable fastener arrangement that is leak resistant.

SUMMARY OF THE INVENTION

The present invention is directed to a slider that when used to open and close a fastener on a plastic bag provides a leak resistant closure. The slider has a top, depending side walls, a front or nose portion with a ramp on the nose portion, a rear portion, and a separation member or finger formed on the underside of the top extending from the nose portion toward the rear portion. The ramp can instead be incorporated into the shape of the separation member. The leak resistant feature is accomplished by withdrawing the operable portion of the separation member from cooperating features of the fastener. The separation member has a wide portion and a narrow portion. The fastener includes a pair of tracks and each track has an interlocking profile. Each track has two ends with a termination on each end. As the slider closes the fastener, the wide and narrow portions of the separation member move within the fastener with the wide portion holding the profiles open. As the slider is moved to close the fastener, the fastener passes along the separation member from the wide portion to the narrow portion and this along with body of the slider moves the profiles together interlocking the profiles. This action is reversed during the fastener opening movement of the slider. One example of this opening and closing is described in U.S. Pat. No. 5,007,143 which is incorporated by reference herein. When the slider reaches the termination at the end of the fastener, the ramp on the slider engages and travels up the termination. As this occurs, the slider is pivoted up which moves the wide portion of the separation member out of from between the fastener allowing the profiles to interlock up to the termination. The shape and positioning of the ramping surfaces and the relative location of slider retention shoulders control the change in orientation of the slider and the stiffness of the fastener is also a factor. The ramp can include a lock such as an indention which snap locks onto the termination and reduces the likelihood of the slider accidently being moved to open the fastener enough to allow leakage.

BRIEF DESCRIPTION OF THE DRAWINGS

Other objects and advantages of the invention will become apparent upon reading the following detailed description in conjunction with the drawings in which:

FIG. 8 is a cross sectional view of an alternative embodiment of a fastener slider arrangement;

FIG. 9 is a partial cross sectional view of a fastener slider arrangement illustrating the forces on and action of the slider during parking;

FIG. 10 is a cross sectional view of a slider on a fastener; and

FIG. 11 is a cross sectional view of a slider on a fastener illustrating the reaction of the slider and fastener during parking of the slider.

DETAILED DESCRIPTION OF THE PREFERRED EMBODIMENTS

Figure 1:
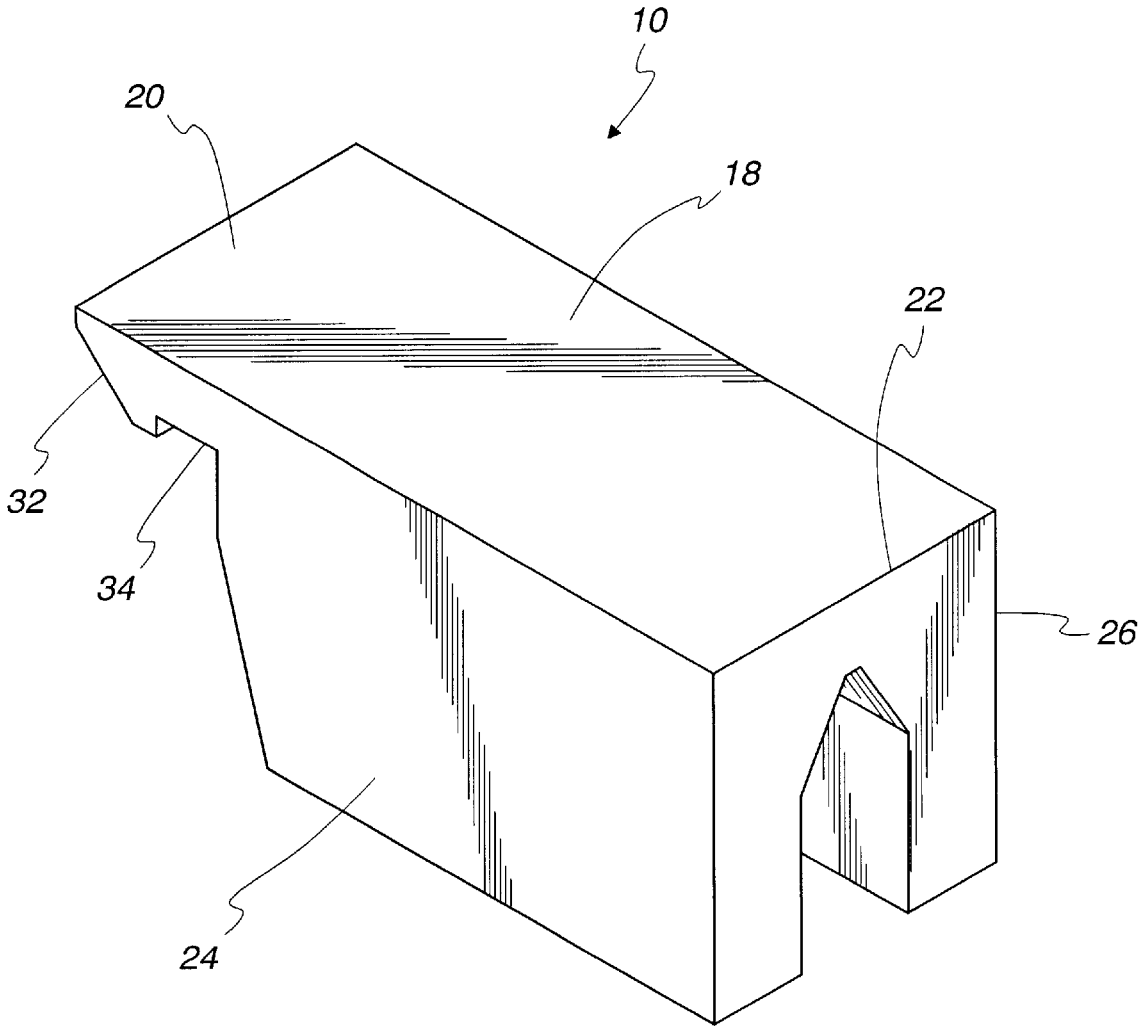
FIG. 1 is an enlarged perspective view of a slider constructed in accordance with the principles of the present invention.

Referring initially to FIG. 1, there is illustrated a slider 10 that when combined with a fastener 12 (FIGS. 4 and 5) eliminates the need for a slider parking notch to provide a leak resistant closure of the fastener 12. A parking notch is a notch cut in the tracks of prior art fasteners in which a slider is located in a fastener closed position such that a separation finger on the slider is out of engagement with tracks on the fastener allowing the fastener to be fully closed. As will be described in detail hereinafter, the need for a parking notch is eliminated by docking or parking the slider 10 on an fastener end termination such as an end termination clip 14 (FIG. 5) which lifts at least a portion of a separation finger or member 16 (FIG. 3) on the slider 10 out from between the fastener 12 allowing complete closure of the fastener 12.

Figure 2:
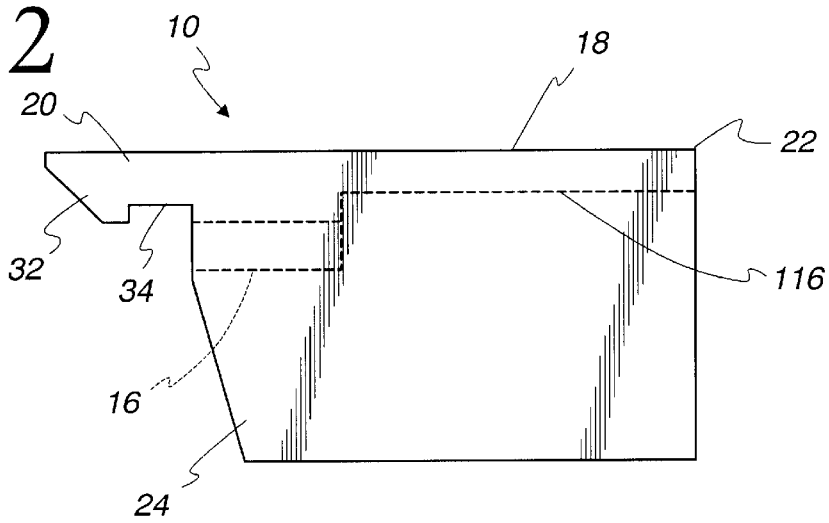
FIG. 2 is a side elevation view of the slider illustrated in FIG. 1.
Figure 3:
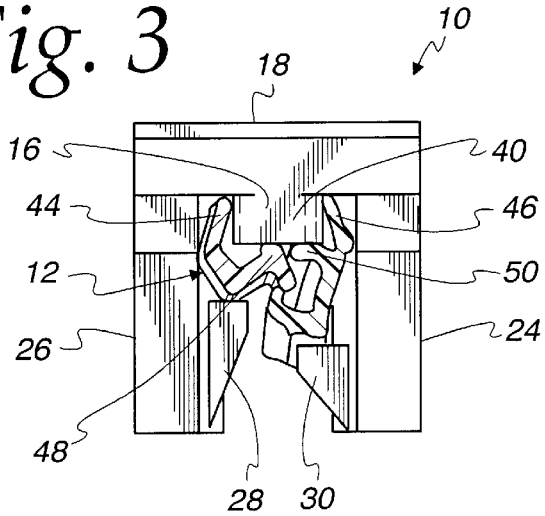
FIG. 3 is a front view of the slider on a fastener.

To understand how a leak resistant fastener and slider arrangement is accomplished reference is first made to the slider 10 (FIGS. 1–3). The slider 10 is of the type described in U.S. Pat. No. 5,007,143 and this patent is incorporated by reference in its entirety. The slider 10 includes a top 18 with a forward portion or nose 20 and a rear portion 22. A pair of sides or side walls 24 and 26 depend downwardly from the top 18. At the lower end of each side wall 24 and 26 are shoulders 28 and 30 (FIGS. 3 and 4), respectively, which cooperate with the separation finger 16 to assist in opening and closing the fastener 12.

Figure 5:
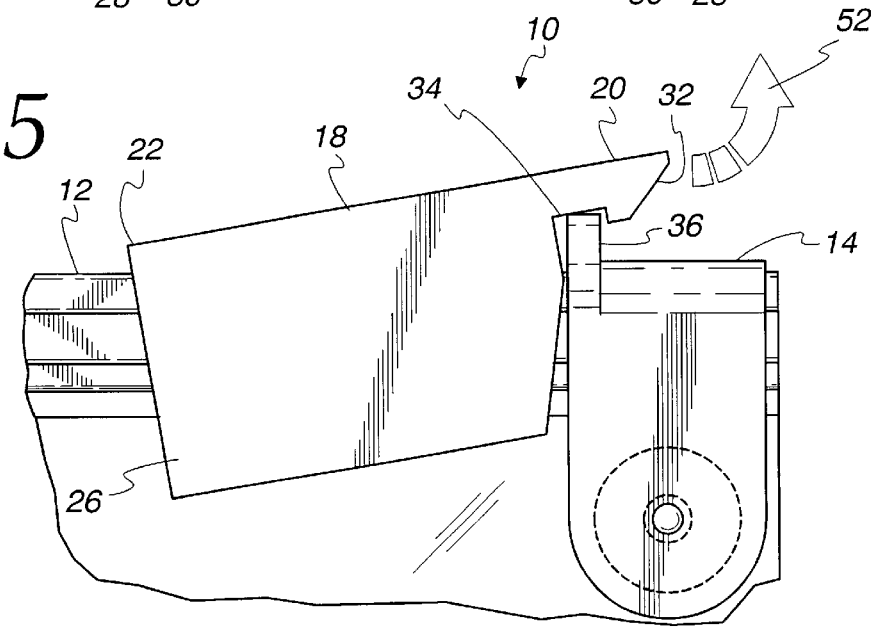
FIG. 5 is a side elevation view of the slider and fastener with the slider locked on an end termination clip.

The nose 20 of the slider 10 extends forward of the top 18 and has an inclined ramp 32 on the front under side of the nose 20. An indention or lock 34 (FIG. 2) is formed on the under side of the slider nose 20 behind the ramp 32. The lock 34 snaps onto an enlarged end 36 of the termination clip 14 after the ramp 32 has passed over the end 36 in the fastener closed position (FIG. 5).

Figure 4:
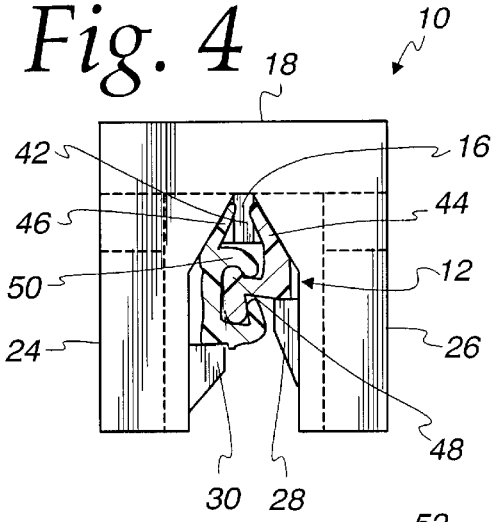
FIG. 4 is a cross sectional view of the slider and fastener of the present invention in the fastener closed configuration.
Figure 6:
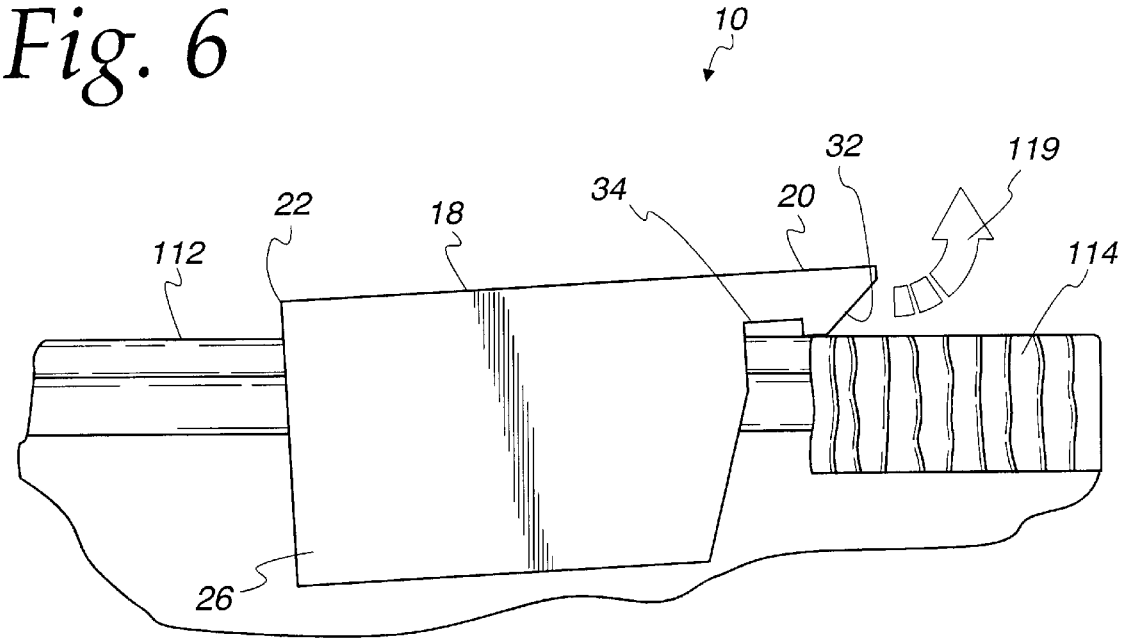
FIG. 6 is a view similar to FIG. 5 with the slider on an terminal end of the fastener.
Figure 7:
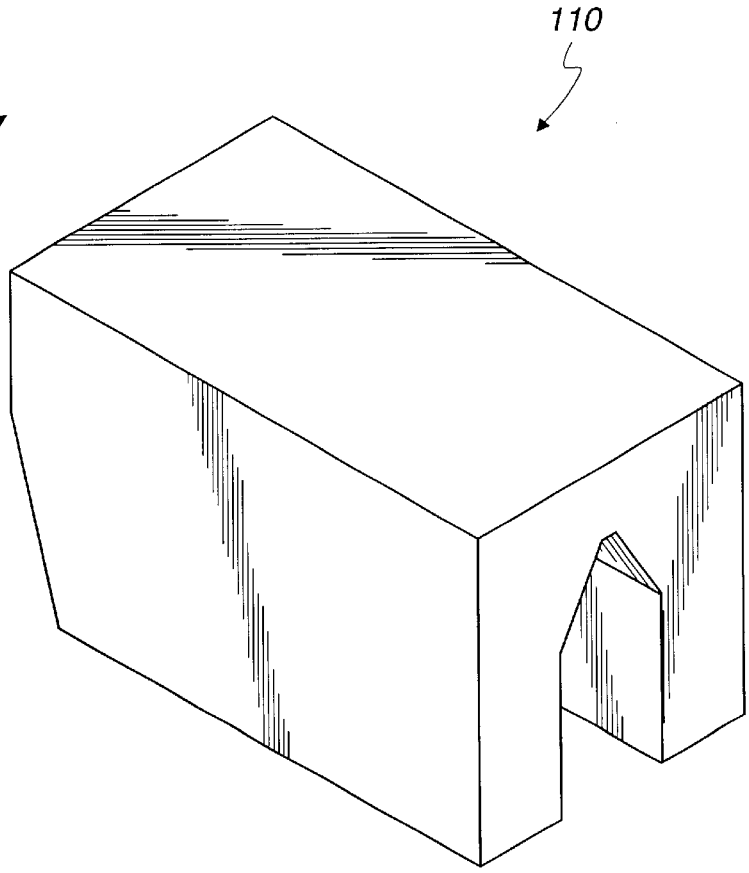
FIG. 7 is a perspective view of an alternative embodiment of the slider.

The separation finger 16 has a first wide portion 40 (FIG. 3) and a second narrow portion 42 (FIG. 4). The separation finger 16 with the first and second portions 40 and 42 interact with first and second portions 44 and 46 (FIGS. 6 and 7) of the fastener 12 to lock and unlock first 48 and second 50 profiles on the fastener 12 thereby opening and closing the fastener 12 in the manner described in U.S. Pat. 5,007,143. More specifically, the wide portion 40 of the separation finger 16 in cooperation with the shoulders 28 and 30 spread the first and second portions 44 and 46 which separates the first and second profiles 48 and 50 thereby opening the fastener 12 (FIG. 6) as the slider 10 is moved. To close the fastener 12, the slider 10 is moved in the reverse direction and the narrow portion 42 of the separation finger 16 cooperates with the shoulders 28 and 30 and the sides 24 and 26 of the slider 10 to bring the first and second portions 44 and 46 together which brings together and locks the first and second profiles 48 and 50 (FIG. 7).

To close the fastener 12 completely, at least the wide portion 40 of the separation finger 16 is removed from between the first and second portions 44 and 46. This is accomplished by docking or parking the nose 20 of the slider 10 on the end 36 of the termination clip 14 (FIG. 5). As the slider 10 closes the fastener 12 and approaches the termination clip 14, the ramp 32 engages the end 36 of the clip 14 causing the nose 20 and that end of the slider 10 to rock or rotate upwardly in the direction of the arrow 52 in FIG. 5. As this action occurs, the wide portion 40 of the separation finger 16 is moved up and out from between the fastener portions 44 and 46. Since only the narrow portion 42 of the separation finger 16 is between the first and second portions 44 and 46, the first and second profiles 48 and 50 lock along the entire length of the fastener 12 up to the termination clip 14. Upon complete closure of the fastener 12, the slider 10 is locked on the termination clip 14 by the lock 34 snapping onto the end 36 of the termination clip 14 (FIG. 5).

To open the fastener 12, the slider 10 is grasped and moved away from the termination clip 14. As the slider 10 begins to move, the lock 34 moves off of the end 36 of the termination clip 14 and the ramp 32 slides over the end 36. As this occurs, the wide portion 40 of the separation finger 16 moves between the first and second fastener portions 44 and 46 to separate the first and second profiles 48 and 50 and open the fastener 12.

Although the fastener 12 is terminated by a clip 14 in the embodiment illustrated in FIGS. 1–5, other forms of terminating the ends of the fastener 12 will also provide the desired result. For example, FIG. 6 illustrates a fastener 112 that is terminated by an end weld 114. The end weld 114 may be formed by heated bars pressed against the end of the fastener 112, ultrasonic welding or other ways known in the art. As the slider 10 approaches the end weld 114, the wide portion 40 of the separation finger 16 encounters increased resistance as it attempts to spread the first and second fastener portions 44 and 46 which are tightly bound in a closed configuration by the end weld 114. The convergence of the first and second fastener portions 44 and 46 behind the separation finger 16 and the transition into the end weld 114 form a natural ramp on which the ramp 32 and nose 20 of the slider 10 ride. This action rocks the slider 10 in the direction of the arrow 119 (FIG. 6) moving the wide portion 40 of the separation finger 16 from between the first and second fastener portions 44 and 46 as in the embodiment of FIGS. 1–5. This action is reversed as the slider 10 is pulled away from the end weld 114 to open the fastener 112.

If desired, the nose 20 with the ramp 32 can be eliminated from the slider 10. Such a slider 110 is illustrated in FIG. 7. Except for a nose and ramp, the slider 110 is identical to slider 10. Both the sliders 10 and 110 function to close a zipper 12 completely. As each slider 10 and 110 approaches a zipper end termination 14 or 114, an elastic twisting deformation of the zipper profiles 48 and 50 occurs. The deformation is caused by abrupt change in the orientation of the profiles 48 and 50 from spread apart to interconnected. The deformation of the profiles by the slider 10 or 110 increases the magnitude of the reaction force against the separation finger 16. The deformed profiles 48 and 50 form a ramp which shifts the contact point with the slider 10 or 110 resulting in a reaction force with an upward component in the direction of arrow 112 (FIGS. 8 and 9). This upward force causes a rotational moment 114 (FIGS. 9 and 11) on the slider 10 or 110 about the shoulders 28 and 30 in a direction that lifts the separation finger 16 out from between the profiles 48 and 50. Referring to FIG. 9, the distance D between the upward reaction force 112 to the shoulders 28 and 30 affects the magnitude of the moment indicated by the arrow 114 acting to lift or disengage the separation finger 16 from the profiles 48 and 50.

Lifting of the separation finger 16 occurs due to a clearance 116 (FIG. 10) between the slider 110 or 10 and the profiles 48 and 50. A shown in FIG. 9, the upward reaction force 112 rotates the slider 10, 110 relative to the fastener 12 to the extent allowed by the clearance 116. Because the slider 10, 110 is rigid, additional relative motion, if required, will only occur through elastic deformation of the portion of the profiles 48 and 50 within the slider 10, 110. The beam stiffness of the profiles 48 and 50 and the unsupported lengths D1 and 116 (FIG. 11) determine how much force is required to lift or move the separation member 16 out of the profiles 48 and 50. This rocking of the slider 10, 110 can be accomplished by the engagement of the ramp 32 with the end termination 14, 214 or the weld 114.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A slider for a reclosable fastener for plastic bags, comprising:

a body, said body including a top, pair of sides, a nose portion and a rear portion, a ramp on said nose portion, a locking portion on said ramp, and a separation member on an underside of said top extending from said ramp toward rear portion.

2. The slider claimed in claim 1 said separation member including a wide section and a narrow section, said wide section adjacent said ramp portion, said narrow section extends from said wide section toward said rear portion of said body.

3. A method of closing a fastener on a plastic bag to minimize leakage across the closed fastener wherein the fastener includes first and second tracks having respective first and second interlocking profiles and respective first and second portions extending above said first and second profiles, and first and second ends with terminations at said first and second ends, comprising:

providing a slider on the first and second tracks of the fastener, said slider including a separation member;

locating said separation member between said first and second portions;

closing said fastener by moving said slider toward one of said terminations; and moving said slider onto said one of said terminations to cause at least a portion of said separation member to disengage from said first and second portions, wherein moving said slider onto said one of said terminations lifts said slider and elastically deflects said fastener.

4. The method of closing a fastener claimed in claim 3 comprising: releasably locking said slider onto said one of said terminations.

* * * * *